US006017669A

United States Patent [19]

Unno et al.

[11] Patent Number: 6,017,669

[45] **Date of Patent: *Jan. 25, 2000**

[54] TONER FOR DEVELOPING AN ELECTROSTATIC IMAGE

[75] Inventors: Makoto Unno, Tokyo; Takaaki Kotaki, Yokohama; Yushi Mikuriya; Tadashi Doujo, both of Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,433

[22] Filed: Sep. 18, 1996

[30] Foreign Application Priority Data

Sep. 20, 1995 [JP] Japan ..... 7-264641

[51] Int. Cl.[7] ..... G03G 9/087

[52] U.S. Cl. ..... 430/109; 430/110

[58] Field of Search ..... 430/109, 904, 430/110

[56] References Cited

U.S. PATENT DOCUMENTS

| | | | |
|---|---|---|---|
| 2,297,691 | 10/1942 | Carlson . | |
| 5,169,738 | 12/1992 | Tanikawa et al. | 430/106.6 |
| 5,330,871 | 7/1994 | Tanikawa et al. | 420/110 |
| 5,364,722 | 11/1994 | Tanikawa et al. | 430/110 |
| 5,483,327 | 1/1996 | Taya et al. | 355/245 |
| 5,578,408 | 11/1996 | Kohtaki et al. | 430/109 |
| 5,597,674 | 1/1997 | Suzuki et al. | 430/109 |

FOREIGN PATENT DOCUMENTS

| | | |
|---|---|---|
| 0568309 | 11/1993 | European Pat. Off. . |
| 0618511 | 10/1994 | European Pat. Off. . |
| 0662638 | 7/1995 | European Pat. Off. . |
| 0662640 | 7/1995 | European Pat. Off. . |
| 0663621 | 7/1995 | European Pat. Off. . |
| 42-23910 | 11/1967 | Japan . |
| 43-24748 | 10/1968 | Japan . |
| 59-228658 | 12/1984 | Japan . |
| 62-195678 | 8/1987 | Japan . |
| 63-225244 | 9/1988 | Japan . |
| 63-225245 | 9/1988 | Japan . |
| 63-225246 | 9/1988 | Japan . |
| 3-87753 | 4/1991 | Japan . |
| 3-203746 | 9/1991 | Japan . |
| 4-24648 | 1/1992 | Japan . |
| 5-249736 | 9/1993 | Japan . |

*Primary Examiner*—Christopher D. Rodee
*Attorney, Agent, or Firm*—Fitzpatrick, Cella, Harper & Scinto

[57] ABSTRACT

The toner for developing an electrostatic image has toner particles containing at least binder resin and colorant. The resin components of a range of 2,000 to 100,000 in molecular weight, prepared by preparatory liquid chromatograph from the binder resin, exhibit an M/S ratio of 200 or greater and are 50% to 90% in abundance. The M and S stand for a weight average molecular weight (M) measured by means of light scattering method and an inertia radius (S) measured by means of light scattering method, respectively.

11 Claims, 2 Drawing Sheets

TONER FOR DEVELOPING AN ELECTROSTATIC IMAGE

BACKGROUND OF THE INVENTION

1. Field of the Invention

The present invention relates to toner for developing an electrostatic image, for use with image forming methods such as electrophotography, electrostatic recording, electrostatic printing, and the like.

2. Related Background Art

There are many known methods for electrophotography, such as those disclosed in U.S. Pat. No. 2,297,691, Japanese Patent Publication No. 42-23910, and Japanese Patent Publication No. 43-24748. Generally, a photo-electroconductive material is employed to form a latent electrical image upon a photosensitive member by means of a variety of means, then the aforementioned latent image is developed using toner and transferred as necessary to a transfer mediums such as paper, and the image is fixed to the transfer medium by means of heating, pressurizing, heating and pressurizing, or solvent vapor, thereby obtaining a toner image.

While there are may methods and apparatuses which have been developed relating to the aforementioned final process of fixing the toner image to a sheet such as paper, at the present, the most common method is the pressurizing-heating method using a heating roller. The pressurizing-heating method using a heating roller fixes a toner image to the fixing sheet material by causing the sheet on which the image is to be fixed to pass across a heating roller which has separatability regarding toner, in such a manner that the surface of the roller comes into contact with the toner image side of the fixing sheet and applies pressure thereto. This method allows of speedy fixing, since the thermal efficiency of fusing the toner image upon the fixing sheet is excellent, due to the heating roller and the toner image on the fixing sheet coming into direct contact under pressure.

The present state is, though, that different toners are being used for the various types of photocopiers and printers. This is mainly due to the difference in fixing speed and fixing temperature of the apparatuses. These differences are resultant of the fact that an offset phenomena is greatly affected by the fixing speed and fixing temperature. The offset phenomena is a phenomena wherein part of the toner image, being in a molten state when coming into contact with the surface of the heating roller, adheres to the surface of the fixing roller during pressurization, and the toner which has adhered to the fixing roller is then re-transferred to the next sheet, thereby soiling it. Generally, the heating roller temperature is set at a low temperature in the event that the fixing speed is slow, and the heating roller temperature is set at a high temperature in the event that the fixing speed is fast. This is to stabilize the amount of heat provided to the toner by the heating roller for fixing the image at an approximate constant, regardless of the fixing speed.

However, there are several layers of toner formed on the sheet to which the image is to be fixed. Accordingly, particularly with systems wherein the fixing speed is fast and the heating roller temperature is high, the temperature difference between the toner layer which comes into contact with the heating roller and the toner layer wich is in contact with the fixing sheet becomes extremely great. Consequently, the topmost layer exhibits toner offset if the temperature of the heating roller is high. On the other hand, if the temperature of the heating roller is low, the toner in the bottom-most layer is not molten sufficiently, meaning that the toner is not completely fixed to the fixing sheet, thereby resulting in a phenomena called low-temperature offset.

A method generally practiced in order to solve this problem is to cause toner anchoring to the fixing sheet by raising the contact pressure during fixing, in the event that the fixing speed is fast. By employing such a method, the temperature of the heating roller can be lowered to a certain extent, and high-temperature offset phenomena occurring at the topmost layer can be prevented. However, this causes an extremely great shearing force to be placed on the toner, resulting in wrapping offset wherein the fixing sheet is wrapped onto the fixing roller, or visibly leaving traces of separating members for separating the fixing sheet from the fixing roller, such as separating claws, on the image. Moreover, this method can cause deterioration of the fixed image such as lines being smashed out of form during fixing or toner being splattered on the image, due to the high pressure.

Accordingly, high-speed fixing is generally conducted by using toner which is lower in melting viscosity than that used for fixing at slower speeds, thereby lowering the heating roller temperature and fixing pressure, so that the fixing can be conducted while preventing high-temperature offset and wrapping offset. However, when such toner with a low melting viscosity is employed for low-speed fixing, offset tends to occur at higher temperatures, owing to the low viscosity thereof.

Methods for lowering the viscosity of the toner include such as lowering the glass transition point of the polymers or lowering the molecular weight thereof. However, in the event that the former method is employed, the storability of the toner is diminished, and in the event that the latter method is employed, the ability to avoid offset at high temperatures and frictional electrification properties deteriorate, and further, adhesion of toner to the photosensitive member occurs more easily. Regarding methods for increasing the degree of branching of polymers on vinyl resins, disclosed in Japanese Patent Application Laid-Open No. 3-87753 and Japanese Patent Application Laid-Open No. 3-203746 is a method using macro-monomers, and disclosed in Japanese Patent Application Laid-Open No. 4-24648 is a method using $\epsilon$'-caprolactone-modified hydroxy vinyl monomers. However, when much macro-monomers are used in these methods to make higher the branching degree, the glass transition temperature of the resin is lowered, thereby deteriorating the storability.

As for methods for maintaining the storability of the toner at a favorable level, the following may be given: increasing the molecular weight of the main chain of the polymer so as to raise the glass transition temperature thereof; or altering the monomer composition of the main chain of the polymer so as to raise the glass transition temperature without changing the molecular weight. However, whichever of these methods is used, the fixing temperature rises, and consequently the effects of lowering fixing temperature by means of increasing the degree of branching are diminished. This is owing to the great effects of the composition of macro-monomers in the polymer. Polymerization of a great quantity of macro-monomers within the polymer chain worsens the storability of the toner. Accordingly, in order to improve the storability of the polymers, the glass transition temperature of the main chain must be further raised for the sake of some of the polymers which have an uneven distribution of a great quantity of macro-monomers, resulting in deterioration of fixability. In other words, the increase in viscosity due to the increase in glass transition temperature of the main chain cancels out the effects of lowering viscosity by means of branching, owing to the overly-great difference in the glass transition temperature between the main chain and the branched chain.

As for methods for increasing the degree of branching of polyester resins, methods using polycarboxylic acid or polyahydric alcohol, having 3 or more hydroxyl or carboxyl groups, or using dicarboxylic acid with side chain or diol with side chain, are disclosed in Japanese Patent Application Laid-Open No. 59-228658 and Japanese Patent Application Laid-Open No. 62-195678. However, as mentioned regarding vinyl resins, the increase in glass transition temperature of the main chain cancels out the effects of lowering viscosity attempted by means of lowering the glass transition temperature of the polymer and increasing branching, since the side chain of dicarboxylic acid or diol with side chain are of aliphatic groups. Regarding the method using the polycarboxylic acid or polyhydric alcohol, the degree of branching is increased, but the gel content (matter insoluble in THF) increases as well, so that while high-temperature offset is improved, the fixing temperature increases.

In Japanese Patent Application Laid-Open Nos. 63-225244 through 225246, methods using a blend of two types of non-linear polyester with differing softening points are disclosed, and disclosed in Japanese Patent Application Laid-Open No. 5-249736 is a method using a resin comprised of high-density crosslinkage micro-gel particles containing linear portions and crosslinked portions.

With the former method, adjustment of the degree of branching is extremely difficult, since preparation thereof is made with dicarboxylic acid and dihydric alcohol being placed in the same container with polycarboxylic acid or polyhydric alcohol having 3 or more hydroxyl or carboxyl groups.

As can be understood, there is demand for a toner for heating and pressurizing fixing which has a wide fixing temperature range suitably adaptable to speeds both low and high, and has excellent anti-offset properties.

Further, in recent years, digitalization of photocopiers and further reduction in the size of toner particles proceed while aiming at higher image quality in copied images. It is required that photograph images containing characters exhibit clarity in the characters and that photograph images themselves exhibit density gradation true to the original. Generally, when taking copies of photograph images containing characters, raising the line density in order to make the characters clear not only degrades the density gradation of the photograph image, but also causes a very rough image at the half-tone portions.

Further, raising the line density may result in a phenomena called "hollowing-out", wherein the large amount of toner deposited on the recording medium during the toner transfer process causes some of the toner to adhere to the photosensitive member against which it is pressed, thereby pulling out some of the toner in the central portions of lines, hence the term. It is needless to say that an image with hollowing out is of poor quality. On the other hand, attempts to improve the density gradation properties of the photograph image lowers the character line density, thereby reducing clarity.

While miniaturization of the toner particles can improve the resolution and clarity of the image, various problems are apt to occur.

In the first place, miniaturization of toner particles diminishes the fixability of half-tone portions. This phenomena is particularly evident in high-speed fixing. This is because there is little toner deposited on the half-tone portions, and the toner transferred to the concave portions of the fixing sheet receive little heat from the heating roller, in addition to the pressure thereof being controlled by the convex portions of the fixing sheet. The toner particles transferred to half-tone images at the convex portions of the fixing sheet are each subjected to shearing force much greater than that of solid portions where the toner layer is thick. This is because the toner layer is thin, and such a condition may result in offset phenomena and copied images of low quality.

Further, making the toner particles smaller increases the surface area of the toner per unit weight, thereby increasing the range of toner charge distribution, consequently making it easier for fogging to occur. When the surface area of the toner per unit weight is increased, the frictional electrification properties of the toner is liable to be affected by the environment. If the toner particles are made to be too small, the dispersion state of magnetic material and colorant tends to more affect the charging properties of the toner. When such small toner particles are used in high-speed photocopiers, over-charging tends to occur in low-humidity conditions, causing fogging and decrease in density.

In using multi-functional photocopiers which use light exposure to leave part of an image blank for inserting an image of another color in multi-color copying, or to create a blank frame around the edges of the copying paper, fogging tends to occur at the image portions which have been left blank. When strong light is used to erase the image by applying a potential which is inverse to the latent image potential by means of light-emitting diodes or fuse lamps, the tendency for fogging to occur at that portion increases even further.

SUMMARY OF THE INVENTION

Accordingly, it is an object of the present invention to provide toner which solves problems such as the aforementioned.

Another object of the present invention is to provide toner which can be used at speeds ranging from low to high without diminishing the fixability thereof and maintaining excellent anti-offset properties.

Still another object of the present invention is to provide toner which can be used at speeds ranging from low to high and exhibiting excellent fixability at half-tone portions even when toner with small grains or minute grains is used, and capable of giving copied images of good quality under such conditions.

A further object of the present invention is to provide toner which can be used at speeds ranging from low to high without fogging, and capable of giving copied images of high density under such conditions.

A still further object of the present invention is to provide toner which is not affected by environmental fluctuations and which is capable of giving copied images of good quality even under conditions of low or high humidity.

Yet, it is another object of the present invention is to provide toner which provides good image quality in a stable manner even when used with high-speed photocopiers, and with a wide range of applicable apparatuses.

Moreover, it is another object of the present invention to provide toner which exhibits excellent endurance, and is capable of giving copied images with high image density and without fogging on white portions, even after prolonged and continuous use.

It is still another object of the present invention to provide toner which, when used for forming photocopies of photograph images containing characters, exhibits clarity in the characters in the copied image, and which gives density gradation true to the photograph images in the original.

It is yet another object of the present invention to provide toner for developing an electrostatic image, comprising toner particles containing at least binder resin and colorant, wherein resin components having a molecular weight in a range of 2,000 to 100,000, prepared by preparative liquid chromatography from the binder resin, exhibits an M/S ratio not smaller than 200, the M/S ratio representing a ratio of an average molecular weight by weight (M) measured by a light scattering method to an inertia radius (S) measured by a light scattering method.

DESCRIPTION OF THE PREFERRED EMBODIMENT

Figure 1:
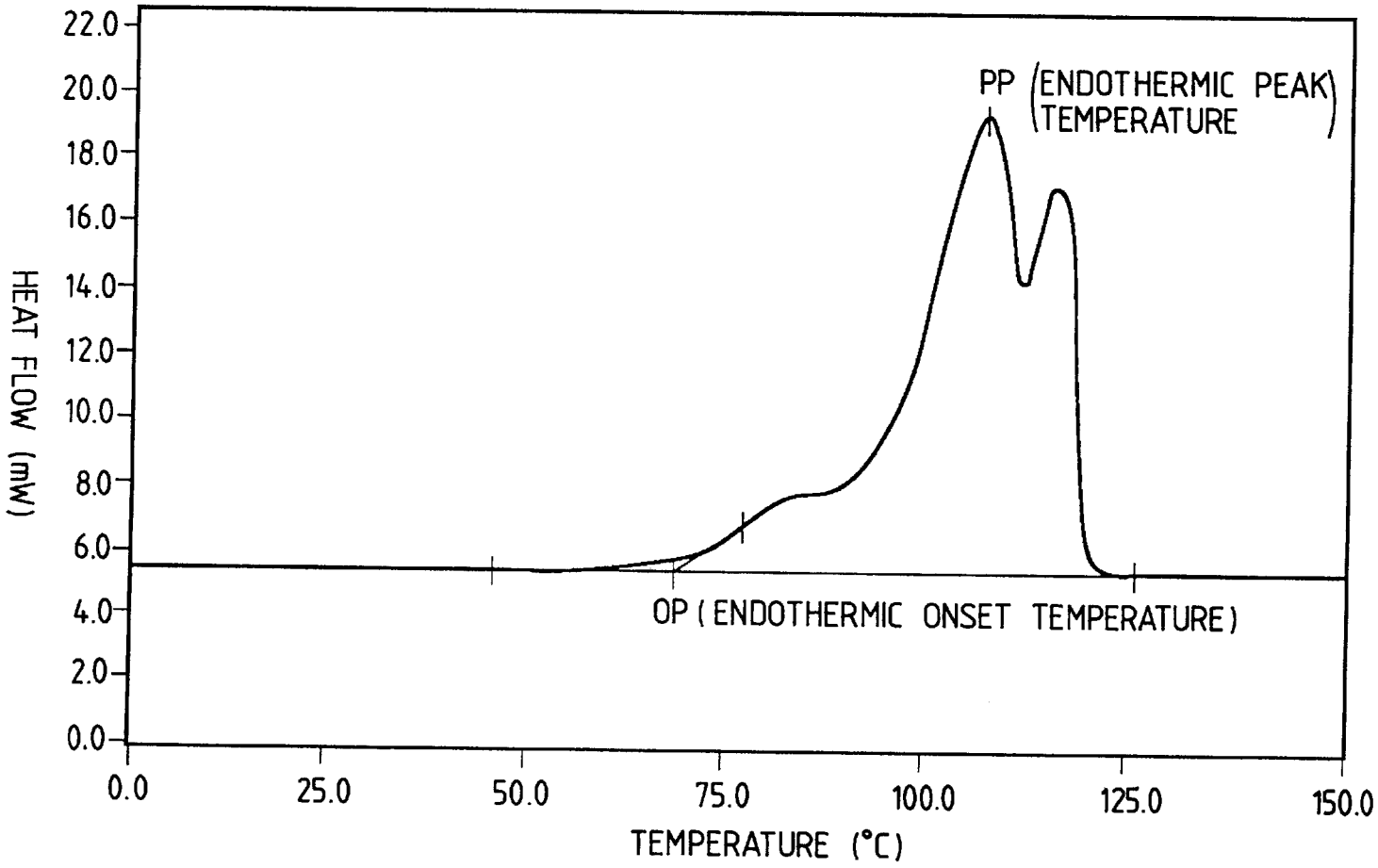
FIG. 1 shows a DSC curve for rising temperature of the wax (b) used in the embodiment of the present invention.

The reason why resin components (polymers) having a range of 2,000 to 100,000 in molecular weight and having been prepared by preparative liquid chromatography was brought to attention regarding the present invention will be described below.

The reason why resin components with molecular weight less than 2,000 are not included is that dimers and trimers of monomers are likely to be formed, instead of forming polymers having branched chains which is the aim of the present invention. This is particularly true with polyester resins.

The reason why resin components, i.e. polymers, with molecular weight greater than 100,000 are not included is that prepared samples show increase in their elasticity rather than their viscosity, so that they are not considered as components for providing good fixability.

The reason for the M/S ratio of 200 or greater in the polymers having a molecular weight in a range of 2,000 to 100,000, which have been prepared by preparative liquid chromatography, is that the molecular weight per unit length of the polymers is great, indicating that there is a great number of branched polymers. Polymers with more branches have a smaller inertia diameter than polymers with less branches, resulting in less interaction between polymers, thereby decreasing viscosity.

When the M/S ratio is less than 200 in the polymers having a molecular weight in a range of 2,000 to 100,000, which have been prepared by preparative liquid chromatography, the viscosity reducing effects due to branching are small even if the polymers are branched, resulting in poor fixability not different from that of unbranched polymers.

The M/S ratio of the polymers having a molecular weight in a range of 2,000 to 100,000, which have been prepared by preparative liquid chromatography, is preferably 300 or greater, more preferably 400 or greater, and most preferably 420 to 2000.

The more the M/S value exceeds 200, i.e., the more the branched polymers exist, the better the dispersibility in the binding resin of the magnetic material, charge controlling agent or other additives is made when manufacturing the toner particles, thereby obtaining good toner developability, selective developability is controlled regarding image properties, and environmental stability is good.

The following describes examples of methods of controlling the branching degree of the binder resin and its glass transition temperature.

With an example for polyester resin, polyester of low molecular weight and polyester of high molecular weight are synthesized separately in advance, and polycarboxylic acid and/or polyhydric alcohol (having 3 or more carboxyl or hydroxyl groups) are added when blending these polyester molecules, thereby conducting condensation polymerization. This method enables synthesis of polyester resin with many branched chains. Further, the length of the branched chains can be controlled by regulating the molecular weight of the polyester synthesized separately in advance. Thus, binder resin which is most favorable for the present invention can be obtained.

With an example for vinyl resin, a trifunctional or greater radical polymerization initiator is added to the reaction system plural times during the polymerization process, thus forming polymers with branched chains. However, if addition of the radical polymerization initiator is not split into plural times but is added at a time, the number of branched chains on each polymer chain is, in almost all cases, smaller than the functional group number of the radical polymerization initiator by two, and consequently, effects of decreased viscosity due to an increased degree of branching in the present invention are hardly obtained.

In the present invention, it is preferable that the amount of resin components in the range of 2,000 to 100,000 according to molecular distribution measurement by Gel Permeation Chromatography (GPC method) for the THF-soluble matter of the binder resin or the toner is 50% to 90%. These resin components are important to provide viscosity and good stability. In the event that the presence of the components in the range of 2,000 to 100,000 is less than 50%, the viscosity of the toner decreases, and fixability deteriorates, particularly, in high-speed photocopiers. In the event that the presence of the components in the range of 2,000 to 100,000 is more than 90%, the viscosity of the toner increases, and the high-temperature anti-offset and wrapping anti-offset properties suffer.

Examples of the binder resin that may be used in the present invention include polyester resin, vinyl resin, and epoxy resin. Of these, polyester resin and vinyl resin are preferable because of stability and charging properties, and polyester resin is particularly preferable.

The following can be given as monomers to be used for forming the polyester resin.

For alcohol components, the following may be exemplified: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; bisphenol derivatives represented by formula A, Formula A

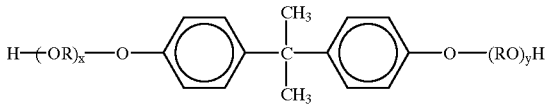

wherein R represents an ethylene or propylene group, x and y each represent an integer of 1 or greater, with the average value of x+y being 2 to 10;

and diols represented by formula B,

Formula B

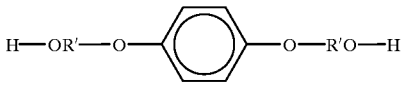

wherein R′ represents $-CH_2CH_2-$, $-CH_2\overset{CH_3}{\overset{|}{C}}H-$, or $-CH_2-\overset{CH_3}{\overset{|}{\underset{CH_3}{\underset{|}{C}}}}-$.

As for the dicarboxylic acid, the following may be exemplified: benzene dicarboxylic acids or anhydrides thereof such as phthalic acid, terephthalic acid, isophthalic acid, and phthalic anhydride; alkyl dicarboxylic acids and anhydrides thereof such as succinic acid, adipic acid, sebacic acid, azelaic acid, and, succinic acid substituted with an alkyl group having 8 to 18 carbon atoms or anhydrides thereof; and unsaturated dicarboxylic acids or anhydrides thereof such as fumaric acid, maleic acid, citraconic acid, and itaconic acid.

Polyhydric alcohols include glycerin, pentaerythritol, sorbitol, sorbitan, oxyalkylene ether of novolak type phenol resins or the like; and polycarboxylic acids include trimellitic acid, pyromellitic acid, benzophenone tetracarboxylic acid, and anhydrides thereof.

It is preferred that the glass transition temperature of the polyester resin is 45 to 80° C., and more preferably 50 to 70° C. The average molecular weight by number (or number average molecular weight) (Mn) according to GPC method is preferably in the range of 1,000 to 80,000, and more preferably 1,500 to 50,000. The average molecular weight by weight (or weight average molecular weight) (Mw) according to GPC method is preferably 5,000 to $1\times10^7$, and more preferably $1\times10^4$ to $5\times10^6$.

When the acid value of the polyester resin is in the range of 2 to 70, and the OH value thereof is 50 or less, more preferably in the range of 2 to 45, the influence of environment conditions such as temperature and humidity becomes less, and the charging properties of the toner are stabilized further.

The following may be exemplified as monomers for forming the vinyl resin: styrene; styrene derivatives such as o-methylstyrene, m-methylstyrene, p-methylstyrene, p-methoxystyrene, p-phenylstyrene, p-chlorstyrene, 3,4-dichlorstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene; ethylenically unsaturated monoolefins such as ethylene, propylene, butylene, isobutylene; unsaturated diolefins such as butadiene; halogenated vinyls such as vinyl chloride, vinylidene chloride, vinyl bromide, vinyl fluoride; vinyl esters such as vinyl acetate, vinyl propionate, vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl aminoethyl methacrylate, diethyl aminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chlorethyl acrylate, phenyl acrylate; vinyl ethers such as vinyl methyl ether, vinyl ethyl ether, vinyl isobutyl ether; vinyl ketones such as vinyl methyl ketone, vinyl hexyl ketone, methyl isopropylphenyl ketone; N-vinyl compounds such as N-vinyl pyrrole, N-vinyl carbazole, N-vinyl indole, N-vinyl pyrrolidone; vinyl naphthalenes; acrylate or methacrylate derivatives such as acrylonitrile, methacrylonitrile, acrylamide; and esters of aforementioned α,β-unsaturated acids, and dibasic acid diesters.

Further examples which may be used as monomers for forming the vinyl resin include: unsaturated dibasic acids such as maleic acid, citraconic acid, itaconic acid, alkenyl succinic acid, fumaric acid, mesaconic acid; unsaturated dibasic anhydrides such as maleic anhydride, citraconic anhydride, itaconic anhydride, alkenyl succinic anhydride; half-esters of unsaturated dibasic acids such as methyl maleate half-ester, ethyl maleate half-ester, butyl maleate half-ester, methyl citraconate half-ester, ethyl citraconate half-ester, butyl citraconate half-ester, methyl itaconate half-ester, methyl alkenyl succinate half-ester, methyl fumarate half-ester and methyl mesaconate half-ester; esters of unsaturated dibasic acids such as dimethyl maleic acid and dimethyl fumaric acid; α,β-unsaturated acids such as acrylic acid, methacrylic acid, crotonic acid and cinnamic acid; α,β-unsaturated acid anhydrides such as crotonic anhydride and cinnamic anhydride; anhydrides of the aforementioned α,β-unsaturated acids and lower fatty acids; alkenyl malonic acid, alkenyl glutaric acid and alkenyl adipic acid, and monoesters thereof and anhydrides thereof, which are vinyl monomers having carboxyl groups.

As for the radical polymerization initiator which is trifunctional or greater, the following may be exemplified: radical polymerization multifunctional polymerization initiators such as tris(t-butyl peroxy)triazine, vinyltris(t-butyl peroxy)silane, 2,2-bis(4,4-di-t-butyl peroxycyclohexyl) propane, 2,2-bis(4,4-di-t-amyl peroxycyclohexyl)propane, 2,2-bis(4,4-di-t-octyl peroxycyclohexyl)propane, 2,2-bis(4,4-di-t-butyl peroxycyclohexyl)butane, and the like. Using the aforementioned method in which such multifunctional polymerization initiators are used, the binder resin having the M/S ratio of 200 or greater can be synthesized.

It is preferable that the vinyl resin has at least one peak within the range of 2,000 to 100,000 of molecular weight in the molecular weight distribution according to GPC, and that there is at least one peak in the range of molecular weight not smaller than 100,000.

The glass transition temperature of the vinyl resin is preferably 45 to 80° C., and more preferably 50 to 70° C.

The toner according to the present invention may use charge controlling agent in order to further stabilize the charging properties thereof. The amount of the charge controlling agent is preferably 0.1 to 10 parts by weight based on 100 parts by weight of binder resin, and more preferably, 0.1 to 5 parts by weight.

The charge controlling agents known at present in this field include the following. As the charge controlling agents which control the toner to have negative charge, organic metal complexes and chelate compounds are exemplified as effective ones. Metal complexes such as monoazo metal complexes, aromatic hydroxycarboxylic acid metal complexes and aromatic dicarboxylic acid metal complexes are named. Other examples include aromatic hydroxycarboxylic acids, aromatic mono- and poly-carboxylic acids and metal salts, anhydrides and esters thereof, and phenol derivatives of bisphenol. As the charge controlling agents which control the toner to have positive charge, compounds of nigrosine or triphenyl methane-type compounds, rhodamine dyes and polyvinyl pyridine may be exemplified.

When preparing color toner, it is preferable that any one of the following two is employed: a binder resin which contains a monomer of an amino-bearing carboxylate such as dimethyl aminomethyl methacrylate which exhibits positive chargeability, in the amount of 0.1 to 40 mol %, and preferably, 1 to 30 mol %; or a colorless or light-colored positive charge controlling agent which does not influence the tone of the toner. Quaternary ammonium salts such as shown in the formulas C and D may be exemplified as the positive charge controlling agents.

Formula C

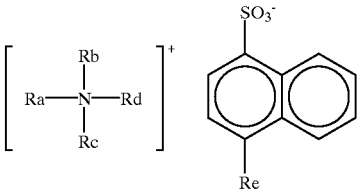

wherein Ra, Rb, Rc, and Rd are each an alkyl group having 1 to 10 carbon atoms or a phenyl groups expressed by

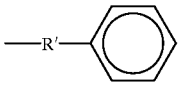

wherein R' represents an alkyl group having 1 to 5 carbon atoms, and Re represents —H, —OH, —COOH, or an alkyl group having 1 to 5 carbon atoms.

Formula D

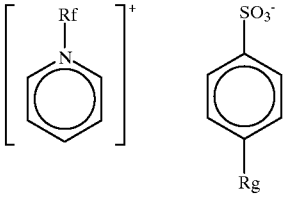

wherein Rf represents an alkyl group having 1 to 5 carbon atoms, and Rg represents —H, —OH, —COOH, or an alkyl group having 1 to 5 carbon atoms.

Of these quaternary ammonium represented by structural formulas C and D, it is more preferable to use the positive charge controlling agents represented by the following structural formulas C-1, C-2, or D-1, as these positive charge controlling agents exhibit good charging properties which are less affected by environmental conditions.

Formula C-1

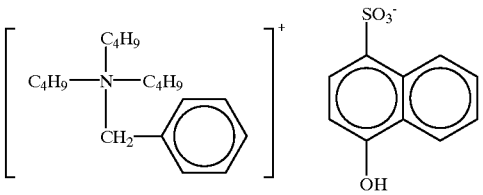

-continued

Formula C-2

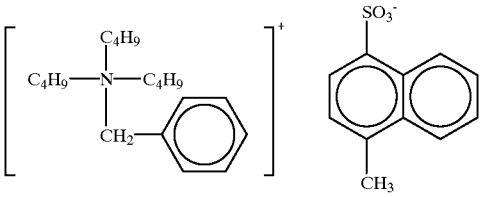

Formula D-1

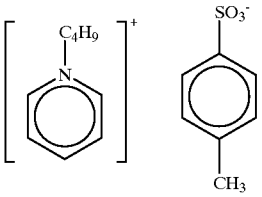

When using an amino-bearing carboxylate such as dimethyl aminomethyl methacrylate which exhibits positive chargeability, as the resin component of the binder resin of the positive charging toner, it is preferable to use a positive charge controlling agent or negative charge controlling agent if necessary.

When an amino-bearing carboxylate such as dimethyl aminomethyl methacrylate which exhibits a positive charge is not used as the resin component of the binder resin of the positive charging toner, it is preferable to use a positive charge controlling agent in the amount of 0.1 to 15 parts by weight based on 100 parts by weight of binder resin, preferably, 0.5 to 10 parts by weight. In the event that an amino-bearing carboxylate is used, it is preferable to use a positive charge controlling agent and/or negative charge controlling agent, if necessary, in the amount of 0 to 10 parts by weight per 100 parts by weight of binder resin, preferably, 0 to 8 parts by weight.

When using the toner according to the present invention as magnetic toner, the following can be used as magnetic material in the magnetic toner: iron oxides such as magnetite, maghemite, and ferrite, as well as iron oxides containing other metal oxides; metals such as Fe, Co, Ni, alloys of these metals with metals such as Al, Co, Cu, Pb, Mg, Ni, Sn, Zn, Sb, Be, Bi Cd, Ca, Mn, Se, Ti, W, and V, and compounds thereof.

The following may be given as examples of the magnetic material: triiron tetroxide ($Fe_3O_4$), iron oxide (III) ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5$—$O_{12}$), copper iron oxide ($CuFe_2O_4$), lead iron oxide ($PbFe_{12}$—$O_9$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like. The aforementioned magnetic materials may be used alone or in a combination of two or more kinds. Magnetic material particularly preferable for the attaining the object of the present invention is fine powder of triiron tetroxide or $\gamma$-iron oxide (III).

Such magnetic material preferably has an average particle diameter of 0.1 to 2 $\mu$m, and, when 10K oersted is applied, magnetic properties of coercive force of 20 to 150 oersted, saturation magnetization of 50 to 200 emu/g, more preferably 50 to 100 emu/g, and residual magnetization of 2 to 20 emu/g.

Preferably, magnetic material should be used in the amount of 10 to 200 parts by weight per 100 parts by weight of binder resin, and more preferably, 20 to 150 parts by weight to the same.

For the colorant, carbon black, titanium white, and all other pigments and/or dyes may be used. Examples of dyes that can be used in an application to magnetic color toner include the following: C.I. direct red 1, C.I. direct red 4, C.I. acid red 1, C.I. basic red 1, C.I. mordant red 30, C.I. direct blue 1, C.I. direct blue 2, C.I. acid blue 9, C.I. acid blue 15, C.I. basic blue 3, C.I. basic blue 5, C.I. mordant blue 7, C.I. direct green 6, C.I. basic green 4, C.I. basic green 6, and the like. Examples of pigments include the following: chrome yellow, cadmium yellow, mineral-fast yellow, navel yellow, naphthol yellow S, hansa yellow G, permanent yellow NCG, tartrazine lake, chrome orange, molybdenum orange, permanent orange GTR, pyrazolone orange, benzidine orange G, cadmium red, permanent red 4R, watching red calcium salt, eosin lake, brilliant carmine 3B, manganese purple, fast violet B, methyl violet lake, ultramarine blue, cobalt blue, alkali blue lake, victoria blue lake, phthalocyanine blue, fast sky-blue, indantherene blue BC, chrome green, chrome oxide, pigment green B, malachite green lake, final yellow green G, and the like.

As for colorants for color toner in application for full-color image forming, the following can be given. Examples of colorant pigments for magenta include: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. pigment violet 19, C.I. vat red 1, 2, 10, 13, 15, 23, 29, 35, and the like.

While pigments may be used alone, it is more preferable for full-color image formation to use pigments along with dyes, thereby improving the clarity and consequently the image quality. Examples of dyes for magenta include: oil solvent dyes such as C.I. solvent red 1, 3, 8, 23, 24, 25, 27, 30, 49, 81, 82, 83, 84, 100, 109, 121, C.I. disperse red 9, C.I. solvent violet 8, 13, 14, 21, 27, C.I. disperse violet 1; and basic dyes such as C.I. basic red 1, 2, 9, 12, 13, 14, 15, 17, 18, 22, 23, 24, 27, 29, 32, 34, 35, 36, 37, 38, 39, 40, C.I. basic violet 1, 3, 7, 10, 14, 15, 21, 25, 26, 27, 28, and the like.

Examples of colorant pigments for cyan include: C.I. pigment blue 2, 3, 15, 16, 17, C.I. vat blue 6, C.I. acid blue 45 or a copper phthalocyanine pigment which is a phthalocyanine skeleton according to the structure shown in Formula E with substituent of 1 to 5 phthalimidemethyl groups thereto; or the like.

wherein n represents 1 to 5.

Examples of colorant pigments for yellow include: C.I. pigment yellow 1, 2, 3, 4, 5, 6, 7, 10, 11, 12, 13, 14, 15, 16, 17, 23, 65, 73, 83, C.I. vat yellow 1, 3, 20, and the like.

Preferably, colorant should be used in the amount of 0.1 to 60 parts by weight per 100 parts by weight of binder resin, and more preferably, 0.5 to 50 parts by weight to the same.

One or more types of release agent may be contained in the toner of the present invention, as necessary. Release agents which may be used in the present invention include the following: aliphatic hydrocarbon waxes such as low-molecular weight polyethylene, low-molecular weight polypropylene, microcrystalline wax, and paraffin wax.

As for aliphatic hydrocarbon waxes, wax obtained according to the following may be used: e.g., low molecular weight alkylene polymers polymerized by either conducting radical polymerization of alkylene under high pressure, or conducting polymerization under low pressure with a Zeigler catalyst; alkylene polymers obtained by thermal decomposition of high molecular weight alkylene polymers; and synthetic hydrocarbons obtained from the distillation residue of hydrocarbons obtained by a synthetic gas comprising carbon monoxide and hydrogen according to Arge method, or by hydrogenating these distillation residue of hydrocarbons. Also, waxes obtained from fractionated hydrocarbon waxes according to such methods as press sweating method, solvent method, employing of vacuum distillation, or fractionated crystallization method may be used. One example of an aliphatic hydrocarbon wax is such that a DSC curve measured by means of a differential scanning calorimeter exhibits the following properties regarding the endothermic peak during rising of temperature and the exothermic peak during dropping of temperature: such that the endothermic onset is within the range of 50 to 110° C., having at least one endothermic peak within the range of 70 to 130° C., and wherein the maximum exothermic peak for dropping temperature exists within a range of ±9° C. of the aforementioned endothermic peak. Hydrocarbons to be used as the host include the following: hydrocarbons with up to several hundred carbon atoms, synthesized by means of reaction between carbon monoxide and hydrogen using metal oxide catalysts (often multi-element) and obtained by means of methods such as the synthol method, hydrocoal method (using, fluid catalysts bed), or Arge method (using, fixed catalysts bed) which can obtain many waxy hydrocarbons; or polymerizing alkylenes such as ethylene by means of a Formula E

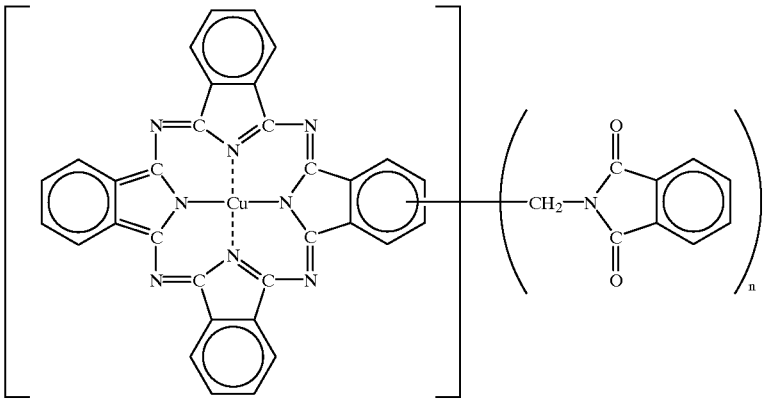

Zeigler catalyst. Also, waxes synthesized according to methods other than polymerizing alkylenes may be used.

The following may be used as release agents: oxides of aliphatic hydrocarbon wax such as polyethylene oxide wax, or block copolymers thereof; waxes with fatty acid ester as the main constituent thereof such as carnauba wax and ester montanic acid wax, and waxes with fatty acid esters with the fatty acid ester thereof partially or completely deoxidized such as deoxidized carnauba wax. Further, the following can also be given as examples: Saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as amide linoleate, amide oleate, and amide laurate; saturated fatty acid bis amides such as methylbisstearamide, ethylenebiscaprylamide, ethylenebislauramide, and hexamethylenebisstearamide; unsaturated fatty acid amides such as ethylenebisoleamide, hexamethylenebisoleamide, N,N'-dioleiladipamide, and N,N'-dioleilsebacamide; aromatic bis amides such as m-xylenebisstearamide and N,N'-distearylisophthalamide; fatty acid metal salts (generally refered to as metal soaps) such as calcium stearate, calcium laurate, zinc stearate, and magnesium stearate; grafted waxes formed by grafting vinyl monomers such as styrene or acrylic acid to aliphatic hydrocarbon waxes; partialy esterized substances of fatty acids such as monoglyceride behenate and polyhydric alcohols; and methylester compounds having hydroxyl groups obtained by means of hydrolyzing vegetable fat and oil.

Release agents preferably used in the present invention include aliphatic alcohol waxes and alkyl monocarboxylic acid waxes. Expression 1 represents aliphatic alcohol wax.

Expression 1

$$CH_3(CH_2)_XCH_2OH \quad (1)$$

wherein X represents an average value, and is in the range of 20 to 250.

Expression 2 represents alkyl monocarboxylic acid wax.

Expression 2

$$CH_3(CH_2)_YCH_2COOH \quad (2)$$

wherein Y represents an average value, and is in the range of 20 to 250.

It is preferable that the amount of release agent used in the present invention be 0.1 to 20 parts by weight per 100 parts by weight of binder resin, and more preferably, 0.5 to 10 parts by weight to the same.

The release agent is generally added to the binder resin using such methods as dissolving the resin in a solvent and raising the temperature of the resin solution which is then agitated, into which the release agent is mixed in, or by mixing in the parting agent when kneading the resin.

Fluidity improving agents may be also used in the toner according to the present invention. Fluidity improving agents which exhibit an increase in fluidity of the toner particles following adding thereof may be used. Examples include: fluorine resin powders such as fine powder of fluorovinylden and fine powder of polytetrafluoroethylene; fine powder silica such as wet method silica and dry method silica; and processed silica where the surface of the aforementioned silica is processed by means of a silane coupling agent, titanium coupling agent, silicone oil, or the like.

A preferable fluidity improving agent is fine powder generated by means of vapor phase oxidation of silicon halogen compounds, and is referred to as dry method silica or humed silica, and is prepared according to known methods. An example is employing heat decomposition oxidation of silicon tetrachloride gas in oxyhydrogen flame, with the following reaction expression being basic.

$$SiCl_4+2H_2+O_2 \rightarrow SiO_2+4HCl$$

In the preparing process thereof, it is possible to obtain composite fine powder substance of silica and other metal oxides by using other metal halogenated compounds such as aluminum chloride or titanium chloride along with the silicon halogenated compound, and such is included as silica. It is preferable for the average primary particle diameter of the silica fine powder to be within the range of 0.001 to 2 $\mu$m, and more preferable to be within the range of 0.002 to 0.2 $\mu$m.

The following are examples of commercially available fine silica powder, generated by means of vapor phase oxidation of silicon halogenated compounds, the product names being listed.

| | |
|---|---|
| AEROSIL (JAPAN AEROSIL CO. LTD) | 130 |
| | 200 |
| | 300 |
| | 380 |
| | TT600 |
| | MOX170 |
| | MOX80 |
| | COK84 |
| Ca—O—SiL (CABOT CO., LTD) | M-5 |
| | MS-7 |
| | MS-75 |
| | HS-5 |
| | EH-5 |
| Wacker HDK N 20 (WACKER-CHEMIE GMBH) | V15 |
| | N20E |
| | T30 |
| | T40 |
| D-C FINE SILICA (DOW CORNING CO. LTD.) | |
| Fransol (Fransil CO., LTD.) | |

Further, it is even more preferable to use processed fine silica powder which is prepared by subjecting the aforementioned fine silica powder generated by means of vapor phase oxidation of silicon halogenated compounds to hydrophobic processing. Particularly preferable is fine silica powder processed so that the hydrophobic degree measured by methanol titration testing shows a value in the range of 30 to 80.

Hydrophobizing is conducted by chemically processing the fine silica powder with organic silicon compounds or the like which react with the fine silica powder or physically adhere thereto. A preferable method is to process the fine silica powder generated by means of vapor phase oxidation of silicon halogenated compounds with organic silicon compounds.

Examples of such organic silicon compounds include: hexamethyl disilazane, trimethyl silane, trimethyl chlorosilane, trimethyl ethoxysilane, dimethyl dichlorosilane, methyltrichlorosilane, allyldimethyl chlorosilane, allylphenyl dichlorosilane, benzyldimethyl chlorosilane, bromomethyldimethyl chlorosilane, α-chloroethyl trichlorosilane, p-chloroethyl trichlorosilane, chloromethyldimethyl chlorosilane, triorgano silylmelcaptan, trimethyl silylmelcaptan, triorgano silylacrylate, vinyldimethyl acetoxysilane, dimethyl ethoxysilane, dimethyl dimethoxysilane, diphenyl diethoxysilane, hexamethyl disiloxane, 1,3-divinyltetramethyl disiloxane, 1,3-diphenyltetramethyl disiloxane, and dimethyl polysiloxanes which have 2 to 12 siloxane units per molecule and a hydroxy group bonded to a single Si atom on each of the units located on the end, and the like. These may be used singularly or as a mixture of a plurality thereof.

The aforementioned dry method silica processed with either the following coupling agents having amino groups, or silicone oil, for used as a positive-chargeable fluidity improving agent.

$H_2NCH_2CH_2CH_2Si(OCH_3)_3$ $H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_3C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

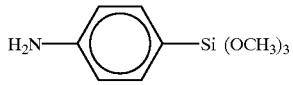

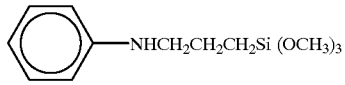

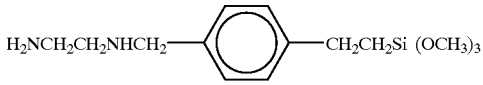

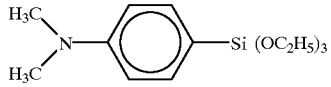

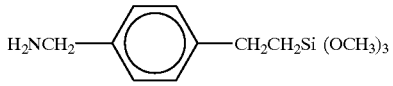

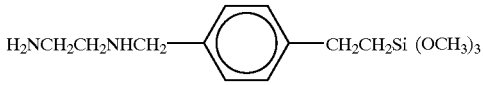

$(HOCH_2CH_2)_2N-CH_2CH_2CH_2Si(OCH_3)_3$ $(H_2CO)_3SiCH_2CH_2CH_2-NHCH_2$ $(H_5C_2O)_3SiCH_2CH_2CH_2NH(H_5C_2O)_3SiCH_2CH_2CH_2$ $H_2CNHCH_2CH_2CH_2Si(OC_2H_5)_3$ $H_2N(CH_2CH_2NH)_2CH_2CH_2CH_2Si(OCH_3)_3$ $H_3C-NHCONHC_3H_6Si(OCH_3)_3$

Amino modified silicone oil possessing a partial structure having amino groups on the side chain of the following formula is generally employed for the silicone oil.

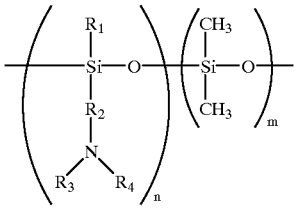

wherein $R_1$ represents a hydrogen atom, alkyl group, aryl group, or alkoxy group; $R_2$ represents an alkylene group or phenylene group; and $R_3$ and $R_4$ are each a hydrogen atom, an alkyl group or an aryl group and wherein the aforementioned alkyl group, aryl group, alkylene group, and phenylene group may contain amine, or may have a substituent group such as halogen or the like to the extent that the charging properties are not affected, and further wherein m and n represent positive integers. The following are examples of such silicone oils containing amino groups.

| Product name | Viscosity at 25° C. (cps) | Amine equivalency |
|---|---|---|
| SF8417 (Manufactured by TORAY SILICONE CO., LTD.) | 1200 | 3500 |
| KF393 (Manufactured by SHIN-ETSU CHEMICAL CO., LTD.) | 60 | 360 |
| KF857 (Manufactured by SHIN-ETSU CHEMICAL Co., LTD.) | 70 | 830 |
| KF860 (Manufactured by SHIN-ETSU CHEMICAL Co., LTD.) | 250 | 7600 |
| KF861 (Manufactured by SHIN-ETSU CHEMICAL Co., LTD.) | 3500 | 2000 |
| KF862 (Manufactured by SHIN-ETSU CHEMICAL Co., LTD.) | 750 | 1900 |
| KF864 (Manufactured by SHIN-ETSU CHEMICAL CO., LTD.) | 1700 | 3800 |
| KF865 (Manufactured by SHIN-ETSU CHEMICAL Co., LTD.) | 90 | 4400 |
| KF369 (Manufactured by SHIN-ETSU CHEMICAL Co., LTD.) | 20 | 320 |
| KF383 (Manufactured by SHIN-ETSU CHEMICAL CO., LTD.) | 20 | 320 |
| X-22-3680 (Manufactured by SHIN-ETSU CHEMICAL Co., LTD.) | 90 | 8800 |
| X-22-380D (Manufactured by SHIN-ETSU CHEMICAL CO., LTD.) | 2300 | 3800 |
| X-22-3801C (Manufactured by SHIN-ETSU CHEMICAL CO., LTD.) | 3500 | 3800 |
| X-22-3810B (Manufactured by SHIN-ETSU CHEMICAL CO., LTD.) | 1300 | 1700 |

The amine equivalency represents the equivalency (g/eqiv) per single amine, and is calculated by dividing the molecular weight by the number of amines per molecule.

The fluidity improving agent provides favorable results when the relative surface area according to nitrogen adsorption measured by the BET method is 30 $m^2/g$ or greater, and more preferably 50 $m^2/g$ or greater. It is preferable that the amount of fluidity improving agent used in the present invention be 0.01 to 8 parts by weight per 100 parts by weight of toner particles, and more preferably, 0.1 to 4 parts by weight to the same.

The toner particles of the present invention may be manufactured by sufficiently mixing the binder resin, coloring agent and/or magnetic material, charge controlling agent, and other additives by means of a mixing machine such as a Henschel mixer or ball-mill, following which the resins are caused to melt together by means of melting and milling using a thermal kneading machine such as a kneader or extruder, and then the molten kneaded material is cooled and solidified, then the solid material is pulverized and classified to obtain toner particles.

Further, the toner particles may be mixed with fluidity improving agent having the same charging polarity as the toner particles, such mixing being conducted by means of a mixing machine such as a Henschel mixer, thereby obtaining toner which has a fluidity improving agent on the surface thereof.

Measurement of the properties of the binder resin were conducted as described below.

(1) Preparation of the range of 2,000 to 100,000 in molecular weight of the binder resin and toner, prepared by preparative liquid chromatography:

Preparation of the range of 2,000 to 100,000 in molecular weight of the binder resin and toner, prepared by preparative liquid chromatography was conducted using recycle preparative equipment, Model HPLC LC-908, manufactured by NIHON BUNSEKI KOGYO CO., LTD. Samples for the preparative liquid chromatography are prepared as follows:

The sample and chloroform are mixed and left standing at room temperature for several hours, e.g., 5 or 6 hours, following which the mixture is shaken to be mixed well i.e., until there are no more sample coalescences, and subsequently further left to stand at room temperature for 12 hours or longer, e.g., 24 hours. The time elapsed from the initial mixing of chloroform and sample to the end of the standing period should be 24 hours or longer. The mixture is then passed through a sample processing filter of a pore size 0.45 to 0.5 $\mu$m, with such as MAISHORI DISK H-25-2 manufactured by TOSO CO., LTD, or EKIKURO DISK 25CR manufactured by GERMAN SCIENCE JAPAN CO., LTD. being preferably employed, thereby obtaining a sample for preparative liquid chromatography.

As for the preparative column used for the preparative liquid chromatography, a preparative column selected from the following is used: JAIGEL-1H, JAIGEL-2H, JAIGEL-3H, JAIGEL-4H, JAIGEL-LS255, JAIGEL-5H, and JAIGEL-6H, manufactured by NIHON BUNSEKI KOGYO CO., LTD.

(2) Measurement of average molecular weight by weight (M) and the inertia radius (S), measured by means of light scattering method:

Measurement of the average molecular weight by weight (M) and the inertia radius (S) was conducted by means of the static light scattering method, using a light scattering method photometer DLS-700 manufactured by OHTSUKA DENSHI CO., LTD. Measurement of the ratio of change of the sample differential refraction index as to the sample concentration (dn/dc) must be made in order to conduct molecular weight measurement according to the static light scattering method. The measurement of dn/dc was carried out using high-sensitivity differential refractometer DRM-1020 manufactured by OHTSUKA DENSHI CO., LTD. The measurement was conducted according to the following procedures.

The resin and toner to be measured are dissolved in tetrahydrofuran (THF) or chloroform and left standing overnight, and then filtered through a 0.2 $\mu$m filter following which the concentration of the sample is adjusted. This concentration-adjusted sample was subjected to testing by changing the intensity and measurement angle of the scattering light, from which the average molecular weight by weight (M) and the inertia radius (S) was obtained according to the following Expression I.

$$\frac{K \cdot C}{R(\theta)} = \frac{1}{M}\left(1 + \frac{16\pi^2}{3\lambda^2}(S^2)\sin^2\frac{\theta}{2} + \ldots\right) + 2A_2C + \ldots \quad \text{Expression I}$$

wherein M represents the average molecular weight by weight, A2 represents a secondary virial coefficient, S represents the inertia radius, C represents the concentration, and k represents the wavelength of the light within the solution;

and wherein $$R(\theta) = \frac{r^2 I_\theta}{V_\theta I_0}$$

wherein θ represents the angle of scattering, $V_\theta$ represents the volume of scattering, $I_\theta$ represents the intensity of the scattered light, $I_0$ represents the intensity of incident light, and r represents the distance from the center of scattering to the observation plane;

and further wherein $$K = \frac{4\pi^2 n_0^2}{N_A \lambda_0^4}\left(\frac{dn}{dc}\right)^2$$

wherein $N_A$ represents an Avogadro number, $\lambda_0$ represents the wavelength of incident light, $n_0$ represents the refraction index of the solvent, and dn/dc represents the ratio of change of the sample differential refraction index as to the sample concentration, measured by means of high-sensitivity differential refractometer DRM-1020.

The average molecular weight by weight (M) and the inertia radius (S) was thus calculated according to Expression I.

(3) Measurement of molecular weight according to GPC method

Molecular weight distribution in a chromatogram by measurement of the binder resin and toner made by GPC method (gel permeation chromatography) is conducted under the following conditions. The measurement sample is prepared as follows:

The sample and tetrahydrofuran (THF) are mixed well at a concentration of approximately 0.5 to 5 mg/ml, e.g., approximately 5 mg/ml, and left at room temperature for several hours, e.g., 5 or 6 hours, following which the mixture is shaken to mix the chloroform and sample together well, i.e., until there are no more sample coalescences, and subsequently further left to stand at room temperature for 12 hours or longer, e.g., 24 hours. The time elapsed from the initial mixing of THF and sample to the end of the standing period should be 24 hours or longer. The mixture is then passed through a sample processing filter of a pore size 0.45 to 0.5 μm, with such as MAISHORI DISK H-25-2 manufactured by TOSO CO., LTD, or EKIKURO DISK 25CR manufactured by GERMAN SCIENCE JAPAN CO., LTD. being preferably employed, thereby obtaining a sample for GPC. The concentration of the sample is then adjusted to be 0.5 to 5 mg/ml.

In the GPC measurement equipment, the column is stabilized within a heat chamber set at 40° C., THF is poured to the column at this temperature at a rate of 1 ml per minute, 100 μl of THF sample solution is injected in, and measurement is made. When molecular weight of the sample is measured, the molecular weight distribution of the sample is calculated from the relation between the logarithm of a calibration curve made from several types of monodispersed polystyrene reference samples, and a counted number. For the reference polystyrene samples, is appropriate to use something manufactured by e.g., TOSO CO., LTD. or SHOWA DENKO CO., LTD., having a molecular weight of around $10^2$ to $10_7$, and to use at least around 10 points of such reference polystyrene samples. A refraction index (RI) detector is used for the detector thereof. A combination of several commercially available polystyrene gel columns is preferable, examples of such to be used in combination being: combinations of shodex GPC KF-801, 802, 803, 804, 805, 806, 807, 800P, manufactured by SHOWA DENKO CO., LTD.; or combinations of TSK gel G1000H($H_{XL}$), G200OH($H_{XL}$), G3000H($H_{XL}$), G4000H($H_{XL}$), G5000H ($H_{XL}$), G6000H($H_{XL}$), G7000H($H_{XL}$), and TSK guard column, manufactured by TOSO CO., LTD.

Generally, with GPC chromatography measurement, the high molecular weight side starts measurement from the point that the chromatogram starts rising from a base line, and the low molecular weight side measures upto a molecular weight of approximately 400.

The abundance ratio of the range of molecular weight of 2,000 to 100,000 in GPC chromatography can be calculated by figuring the ratio of the integrated value of the range of 2,000 to 100,000. Or, the GPC chromatogram may be cut out, the weight of the entirety thereof measured, following which the range of molecular weight of 2,000 to 100,000 is cut out and the weight thereof measured, and by figuring the ratio of the range of molecular weight of 2,000 to 100,000 as compared to the entire weight of the GPC chromatogram, the abundance ratio thereof can be measured.

(4) Glass transition temperature Tg

Measurement is made using differential thermal analysis measurement apparatus (DSC measurement apparatus) DSC-7 (manufactured by PARKIN ELMER CO., LTD.)

5 to 20 mg of measurement sample, preferable 10 mg, is precisely measured. This is placed in an aluminum pan, and using an empty aluminum pan as reference, measurement is made under the conditions of measurement temperature range of 30 to 200° C., temperature increase rate of 10° C./min, and of normal temperature and normal humidity. The endothermic peak of the main peak obtained is in the range of 40 to 100° C. during this temperature rise. The glass transition temperature Tg in the present invention is defined by the intersection between: the line of the central point between the base lines before and after this endothermic peak is detected; and the differential thermal curve.

(5) Measurement of acid value and OH value

1) Regarding Acid Value

The sample is measured precisely, dissolved in a mising solvent and water is added thereto. Potential differential titration of this liquid is conducted with 0.1N—NaOH using glass electrodes, thus measuring the acid value (in accordance with JIS K1557-1970). Regarding the acid value of the developer, attach preparative equipment when conducting measurement of molecular weight distribution, dry the prepared material, and measure in the same manner as the aforementioned.

2) Regarding OH value

Precisely measure 100 ml of the sample into an eggplant type flask, and correctly add 5 ml of acetylated reagent thereto. Subsequently, the flask is immersed in a bath at 100° C.±5° C., and heated. After 1 to 2 hours the flask is retrieved from the bath and cooled, following which water is added and the flask is shaken, decomposing the acetic anhydride. In order to further complete the decomposition, the flask is returned to the bath to heat for 10 minutes or more, then cooled, following which the walls of the flask are washed well with an organic solvent. Potential differential titration of this liquid is conducted with an N/2 potassium hydroxide ethylalcohol using glass electrodes, thus measuring the hydroxyl group value (in accordance with JIS K0070-1966).

The present invention will now be described in further detail with reference to the following examples.

Resin Preparation Example 1

51 mol % of fumaric acid and 49 mol % of the bisphenol derivative represented by Formula A, wherein R is a propylene group and wherein x+y=2.2, were subjected to condensation polymerization, thereby obtaining a polyester resin α wherein the number average molecular weight (Mn) according to GPC method was 2,600, the weight average molecular weight (Mw) was 8,000, and Tg was 50° C. A polyester resin β was obtained by using the same constituent as with a but lengthening the time of condensation polymerization, wherein the number average molecular weight (Mn) according to GPC method was 15,000, the weight average molecular weight (Mw) was 89,000, and Tg was 60° C.

The polyester resins α and β were mixed at a weight ratio of 3:1, trimellitic acid anhydride was added thereto so that the amount thereof was 10 mol %. Condensation polymerization was conducted, thereby obtaining a Resin No. 1 without THF-insoluble components and wherein the number average molecular weight (Mn) according to GPC method was 9,000, the weight average molecular weight (Mw) was 500,000, and Tg was 60° C.

Preparation of resin component of the range of 2,000 to 100,000 in molecular weight of the Resin No. 1, prepared by preparative liquid chromatography, was conducted, and measurement of the weight average molecular weight (M) and the inertia radius (S) was conducted by means of the light scattering method, where the results shows weight average molecular weight (M) of 850,000 and inertia radius (S) of 700 Å, thus the M/S ratio is 1,214.

Resin Preparation Examples 2 to 4

Resins No. 2 to 4 as shown in Table 1 were obtained in the same way as with Resin preparation Example 1, except that the composition, reaction conditions, and blend ratio was changed.

Resin preparation Example 5

The polyester resin α in Resin preparation Example 1 and Resin No. 4 from Resin preparation Example 4 were mixed at a weight ratio of 2:1, trimellitic acid anhydride was added thereto so that the amount thereof was 20 mol %. Condensation polymerization was conducted, thereby obtaining a Resin No. 5 wherein the number average molecular weight (Mn) according to GPC method was 16,000, the weight average molecular weight (Mw) was 842,000, and Tg was 61° C.

Preparation of resin component of the range of 2,000 to 100,000 in molecular weight of the Resin No. 5, prepared by preparative liquid chromatography, was conducted, and measurement of the weight average molecular weight (M) and the inertia radius (S) was conducted by means of the light scattering method, where the results shows weight average molecular weight (M) of 1,176,000 and inertia radius (S) of 3,675 Å, thus the M/S ratio is 320.

Resin Preparation Example 6

The polyester resin α in Resin preparation Example 1 and Resin No. 4 from Resin preparation Example 4 were mixed at a weight ratio of 1:1, trimellitic acid anhydride was added thereto so that the amount thereof was 30 mol %. Condensation polymerization was conducted, thereby obtaining a Resin No. 6 wherein the number average molecular weight (Mn) according to GPC method was 18,200, the weight average molecular weight (Mw) was 887,000, and Tg was 60° C.

Preparation of resin component of the range of 2,000 to 100,000 in molecular weight of the Resin No. 6, prepared by preparative liquid chromatography, was conducted, and measurement of the weight average molecular weight (M) and the inertia radius (S) was conducted by means of the light scattering method, where the results shows weight average molecular weight (M) of 1,278,000 and inertia radius (S) of 5,782 Å, thus the M/S ratio is 221.

Resin Preparation Example 7 (comparative example)

24 mol % of terephthalic acid, 18 mol % of dodecenyl succinate, 8 mol % of trimellitic acid anhydride, 17 mol % of the bisphenol derivative represented by Formula A, wherein R is a propylene group and wherein x+y=2.2, and 33 mol % of the bisphenol derivative represented by Formula A, wherein R is a ethylene group and wherein x+y=2.2, were subjected to condensation polymerization, thereby obtaining a Resin No. 7 with 0% THF-insoluble components and wherein the number average molecular weight (Mn) according to GPC method was 3,180, the weight average molecular weight (Mw) was 48,100, and Tg was 58° C.

Preparation of resin component of the range of 2,000 to 100,000 in molecular weight of the Resin No. 7, prepared by preparative liquid chromatography, was conducted, and measurement of the weight average molecular weight (M) and the inertia radius (S) was conducted by means of the light scattering method, where the results shows weight average molecular weight (M) of 54,600 and inertia radius (S) of 287 Å, thus the M/S ratio is 190.

Resin Preparation Example 8 (Comparative Example)

5 mol % of fumaric acid, 46 mol % of trimellitic acid anhydride, and 49 mol % of the bisphenol derivative represented by Formula A, wherein R is a propylene group and wherein x+y =2.2, were subjected to condensation polymerization, thereby obtaining a Resin No. 8 wherein the number average molecular weight (Mn) according to GPC method was 17,000, the weight average molecular weight (Mw) was 850,000, and Tg was 62° C.

Preparation of resin component of the range of 2,000 to 100,000 in molecular weight of the Resin No. 8, prepared by preparative liquid chromatography, was conducted, and measurement of the weight average molecular weight (M) and the inertia radius (S) was conducted by means of the light scattering method, where the results shows weight average molecular weight (M) of 576,000 and inertia radius (S) of 3,600 Å, thus the M/S ratio is 160.

Resin Preparation Example 9 (Comparative Example)

49.5 mol % of fumaric acid, 0.5 mol % of trimellitic acid anhydride, 25 mol % of the bisphenol derivative represented by Formula A, wherein R is a propylene group and wherein x+y=2.2, and 25 mol % of the bisphenol derivative represented by Formula A, wherein R is a ethylene group and wherein x+y=2.2, were subjected to condensation polymerization, thereby obtaining a Resin No. 9 wherein the number average molecular weight (Mn) according to GPC method was 6,000, the weight average molecular weight (Mw) was 40,000, and Tg was 60° C.

Preparation of resin component of the range of 2,000 to 100,000 in molecular weight of the Resin No. 9, prepared by preparative liquid chromatography, was conducted, and measurement of the weight average molecular weight (M) and the inertia radius (S) was conducted by means of the light scattering method, where the results shows weight average molecular weight (M) of 87,360 and inertia radius (S) of 546 Å, thus the M/S ratio is 160.

Values indicating the properties of Resins No. 1 to 9 are shown in Table 1.

TABLE 1

| Binder resin Nos. | Composition: Low molecular weight components | Composition: High molecular weight components | Blending ratio (Low molecular weight/High molecular weight) | Molecular weight according to GPC method: Mn | Molecular weight according to GPC method: Mw | Glass transition point (° C.) | Light scattering method measurement of preparation of the range of 2,000 to 100,000 in molecular weight prepared by preparative liquid chromatography: Average molecular weight by weight (M) | Inertia radius (S) [Å] | Ratio (M/S) | Acid value | OH value | Abundance ratio of the range of molecular weight of 2,000 to 100,000 according to the GPC method (%) |
|---|---|---|---|---|---|---|---|---|---|---|---|---|
| 1 | .Fumaric acid .Bisphenol derivative represented by Formula A (R = propylene group, x + y = 2.2) | Same as to the left | 3/1 | 9000 | 500000 | 60 | 850000 | 700 | 1214 | 32.5 | 31.4 | 84 |
| 2 | .Terephthalic acid .Adipic acid .Bisphenol derivative represented by Formula A (R = propylene group, ethylene group, x + y = 2.2) | .Fumaric acid .Bisphenol derivative represented by Formula A (R = propylene group, x + y = 2.2) | 2/1 | 12000 | 190000 | 61 | 420000 | 785 | 535 | 28.6 | 30.4 | 81 |
| 3 | .Terephthalic acid .Adipic acid .Bisphenol derivative represented by Formula A (R = propylene group, ethylene group, x + y = 2.2) | .Fumaric acid .Bisphenol derivative represented by Formula A (R = propylene group, x + y = 2.2) | 3/1 | 9000 | 92000 | 57 | 189000 | 432 | 438 | 33.4 | 29.8 | 77 |
| 4 | .Fumaric acid .Bisphenol derivative represented by Formual A (R = ethylene group, x + y = 2.2) | .Bisphenol derivative represented by Formula A (R = propylene group, x + y = 2.2) | — | 15000 | 98000 | 65 | 154000 | 461 | 334 | 28.4 | 27.1 | — |
| 5 | .Fumaric acid .Bisphenol derivative represented by Formula A (R = propylene group, x + y = 2.2) | Same as Resin No. 4 | 2/1 | 16000 | 842000 | 61 | 1176000 | 3675 | 320 | 31.7 | 29.7 | 75 |
| 6 | .Fumaric acid .Bisphenol derivative represented by Formula A (R = propylene group, x + y = 2.2) | Same as Resin No. 4 | 1/1 | 18200 | 887000 | 60 | 1278000 | 5782 | 221 | 32.6 | 30.4 | 71 |
| 7 | .Terephthalic acid .Dodecenyl succinate .Trimellitic acid anhydride | .Bisphenol derivative represented by Formula A (R = propylene group, x + y = 2.2) .Bisphenol derivative represented by Formula A (R = ethylene group, x + y = 2.2) | — | 3180 | 48100 | 58 | 54600 | 287 | 190 | 10.1 | 16.4 | 78 |

TABLE 1-continued

| Binder resin Nos. | Composition: Low molecular weight components | Composition: High molecular weight components | Blending ratio (Low molecular weight/High molecular weight) | Molecular weight according to GPC method: Mn | Molecular weight according to GPC method: Mw | Glass transition point (° C.) | Light scattering method measurement of preparation of the range of 2,000 to 100,000 in molecular weight prepared by preparative liquid chromatography: Average molecular weight by weight (M) | Inertia radius (S) [Å] | Ratio (M/S) | Acid value | OH value | Abundance ratio of the range of molecular weight of 2,000 to 100,000 according to the GPC method (%) |
|---|---|---|---|---|---|---|---|---|---|---|---|---|
| 8 | .Fumaric acid .Trimellitic acid anhydride | .Bisphenol derivative represented by Formula A (R = propylene group, x + y = 2.2) | — | 17000 | 850000 | 62 | 576000 | 3600 | 160 | 26.4 | 25.4 | 47 |
| 9 | .Fumaric acid Trimellitic acid anhydride .Bisphenol derivative represented by Formula A (R = propylene group, x + y = 2.2) | .Bisphenol derivative represented by Formula A (R = ethylene group, x + y = 2.2) | — | 6000 | 40000 | 60 | 87360 | 546 | 160 | 30.4 | 28.7 | 93 |

Resin Preparation Example 10

83 parts by weight of styrene, 12 parts by weight of n-butylacrylate, 5 parts by weight of monobutyl maleate, 1 part by weight of di(t-butyl) peroxide, and 200 parts by weight of xylene were placed in a reactor, the atmosphere therein which was then sufficiently replaced with nitrogen, following which polymerization was initiated at 138 to 144° C. Tris-(t-butyl peroxy)triazine, a multifunctional radical polymerization initiator, represented below was added 5 times after polymerization was initiated, every 30 minutes, 0.3 parts by weight every time. Xylene was removed while raising the temperature to 200° C. under reduced pressure, over the course of 4 hours from polymerization initiation, thus obtaining Resin No. 10.

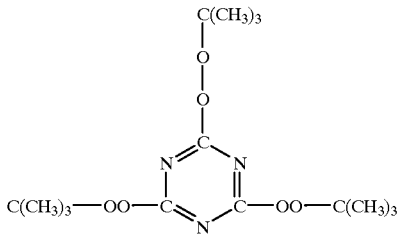

Tris-(t-butylperoxy)triazine

The obtained Resin No. 10 was subjected to the GPC method wherein the number average molecular weight (Mn) was 5,300, the weight average molecular weight (Mw) was 11,300, and Tg was 60° C.

Resin Preparation Example 11

Resin No. 11 was obtained in the same way as with Resin preparation Example 10, except that tris-(t-butyl peroxy) triazine was added 2 times after polymerization was initiated, every hour, 0.3 parts by weight every time.

The obtained Resin No. 11 was subjected to the GPC method wherein the number average molecular weight (Mn) was 5,750, the weight average molecular weight (Mw) was 11,700, and Tg was 59.5° C.

Resin Preparation Example 12

Resin No. 12 was obtained in the same way as with Resin preparation Example 10, except that tris-(t-butyl peroxy) triazine was not added after polymerization was initiated.

The obtained Resin No. 12 was subjected to the GPC method wherein the number average molecular weight (Mn) was 5,470, the weight average molecular weight (Mw) was 11,450, and Tg was 60.7° C.

Resin Preparation Example 13

83parts by weight of styrene, 12 parts by weight of n-butylacrylate, 5 parts by weight of monobutyl maleate, 1 part by weight of di(t-butyl)peroxide, 0.3 parts by weight of tris-(t-butyl peroxy)triazine, and 200 parts by weight of xylene were placed in a reactor, the atmosphere therein which was then sufficiently replaced with nitrogen, following which polymerization was initiated at 138 to 144° C. Xylene was removed while raising the temperature to 200° C. under reduced pressure, over the course of 4 hours from polymerization initiation, thus obtaining Resin No. 13.

The obtained Resin No. 13 was subjected to the GPC method wherein the number average molecular weight (Mn) was 5,470, the weight average molecular weight (Mw) was 11,550, and Tg was 59.8° C.

Resin Preparation Example 14

70 parts by weight of styrene, 24.7 parts by weight of n-butylacrylate, 5 parts by weight of monobutyl maleate, 0.03 parts by weight of divinylbenzene, and 0.1 parts by weight of benzoil peroxide were mixed together, to which mixture 170 parts by weight of water into which had been dissolved 0.12 parts by weight of partially saponificated polyvinyl alcohol was added and violently stirred, so as to make a suspended dispersion solution. 500 parts by weight of water was added to a reactor, the atmosphere therein which was then sufficiently replaced with nitrogen, following which the aforementioned suspended dispersion solution was added, and suspension polymerization reaction was conducted for 8 hours at 80° C. Subsequently, following reaction, the substance was washed, dehydrated, and dried, thus obtaining Resin No. 14.

The obtained Resin No. 14 was subjected to the GPC method wherein the number average molecular weight (Mn) was 236,000, the weight average molecular weight (Mw) was 1,427,000, and Tg was 60.5° C.

Resin Preparation Example 15

A xylene solution of resin was mixed so that Resin No. 10 and Resin No. 14 were mixed at a weight ratio of 4:1, following which the xylene was removed and the substance was dried, thereby obtaining Resin No. 15.

Resin Preparation Example 16

Resin No. 16 was obtained in the same way as with Resin preparation Example 15, except that Resin No. 11 and Resin No. 14 were mixed at a weight ratio of 4:1.

Resin preparation Example 17

Resin No. 17 was obtained in the same way as with Resin preparation Example 15, except that Resin No. 12 and Resin No. 14 were mixed at a weight ratio of 4:1.

Resin Preparation Example 18

Resin No. 18 was obtained in the same way as with Resin preparation Example 15, except that Resin No. 13 and Resin No. 14 were mixed at a weight ratio of 4:1.

Values indicating the properties of Resins No. 15 to 18 are shown in Table 2.

TABLE 2

| Binder resin Nos. | Composition: Low molecular weight components | Composition: High molecular weight components | Blending ratio (Low molecular weight/High molecular weight) | Molecular weight according to GPC method: Mn | Molecular weight according to GPC method: Mw | Glass transition point (° C.) | Light scattering method measurement of preparation of the range of 2,000 to 100,000 in molecular weight prepared by preparative liquid chromatography: Average molecular weight by weight (M) | Inertia radius (S) [Å] | Ratio (M/S) | Acid value | Peak position by measuring molecular weight according to GPC method | Abundance ratio of the range of molecular weight of 2,000 to 100,000 according to the GPC method (%) |
|---|---|---|---|---|---|---|---|---|---|---|---|---|
| 15 | .Styrene .n-butylacrylate .Monobutyl-ester maleate (Resin 10) | .Styrene .n-butylacrylate .Monobutyl-ester maleate (Resin 14) | 4/1 | 6100 | 271000 | 60.1 | 296000 | 1069 | 277 | 13.5 | 11000 876000 | 77 |
| 16 | .Styrene .n-butylacrylate .Monobutyl-ester maleate (Resin 11) | .Styrene .n-butylacrylate .Monobutyl-ester maleate (Resin 14) | 4/1 | 6470 | 273000 | 59.7 | 287000 | 1186 | 242 | 14.1 | 11500 881000 | 76 |
| 17 | .Styrene .n-butylacrylate .Monobutyl-ester maleate (Resin 12) | .Styrene .n-butylacrylate .Monobutyl-ester maleate (Resin 14) | 4/1 | 6360 | 269000 | 60.3 | 273000 | 1936 | 141 | 13.7 | 11200 878000 | 78 |
| 18 | .Styrene .n-butylacrylate .Monobutyl-ester maleate (Resin 13) | .Styrene .n-butylacrylate .Monobutyl-ester maleate (Resin 14) | 4/1 | 6240 | 272500 | 60.2 | 288000 | 2072 | 139 | 13.8 | 11300 877500 | 78 |

Example 1

100 parts by weight of Resin No. 1, 90 parts by weight of magnetic iron oxide (average particle diameter 0.15 μm, Hell5 oersted, σ80 emu/g, arllemu/g), 5 parts by weight of release agent (a) [aliphatic alcohol wax $CH_3(CH_2)_xCH_2OH$ (wherein X=48, and OH value=70)], and 2 parts by weight of monoazo metal complex (negative charge controlling agent) were mixed by means of a Henschel mixer, following which molten kneading was conducted at 130° C. by means of a twin-screw kneading extruder. After naturally cooling the kneaded substance, it was roughly pulverized by means of a cutter mill, following which pulverization was conducted by means of a pulverizer using jet streams, then further classified by means of a pneumatic classifier, thereby obtaining magnetic toner particles having 6.5 μm in weight average particle diameter. 1.0 part by weight of hydrophobic dry-method silica (BET 300 $m^2/g$) was externally added to 100 parts by weight of the magnetic toner particles by means of a Henschel mixer, thus obtaining toner.

Preparation of resin component of the range of 2,000 to 100,000 in molecular weight of this toner, prepared by preparative liquid chromatography, was conducted, and measurement of the weight average molecular weight (M) and the inertia radius (S) was conducted by means of the light scattering method, where the results shows weight average molecular weight (M) of 840,950 and inertia radius (S) of 695 Å, thus the M/S ratio is 1,210.

This toner was evaluated regarding the image properties thereof by means of a digital photocopier GP-55 manufactured by CANON, obtaining favorable results as shown in Table 3-2. The fixing unit of the digital photocopier GP-55 was removed, and external driving and temperature controlling functions were provided to the photocopier, thereby conducting fixing tests at various fixing speeds, obtaining favorable results as shown in Table 3-2.

The density gradation properties were good in the image properties evaluations. Further, the phenomena called selective developing wherein only small toner particles are developed and used did not occur even after 20,000 copies were made, the half-tone image quality was almost unchanged as the initial quality, and a smooth image without irregularities in density was obtained.

The method of evaluation is as follows:

Half-tone Image Quality

The half-tone image quality was evaluated by first making a copy of an A4 size 0.3 half-tone solid full-sheet original, and the copied image was measured at 10 random points by means of a Macbeth reflection densitometer, and the difference between the greatest value and the least value obtained was the standard by which evaluation was conducted. Here, half-tone image quality refers to the uniformity of the density of the half-tone image copied. To say that an image has poor half-tone uniformity or poor half-tone image quality means that the copied half-tone image has irregularities in the density thereof. The following shows the evaluation standards for half-tone image quality.

| Difference between the greatest image density value and the least value | Half-tone evaluation standards |
|---|---|
| Less than 0.10 | A |
| 0.10 or greater but less than 0.15 | B |
| 0.15 or greater but less than 0.20 | C |
| 0.20 or greater but less than 0.25 | D |
| 0.25 or greater | E |

Image Density

The evaluation standard of image density was based on the image density after completing a great number of copies. The following shows the evaluation standards for half-tone image quality.

| Image density after completing a great number of copies | Image density evaluation standards |
|---|---|
| 1.31 or greater | A |
| 1.26 or greater but less than 1.31 | B |
| 1.21 or greater but less than 1.25 | C |
| 1.16 or greater but less than 1.21 | D |
| less than 1.16 | E |

Density Gradation Properties

An image chart with 17 gradation differences in density, including half-tone, is created, and a copy made of that chart is compared visually with the original chart and evaluated on a scale of five.

A Excellent
B Good
C Fair
D Poor
E Bad

Selective Developing

The volume average particle diameters of toner on the developing sleeve following making of many copies and the evaluated toner are each measured by means of the Coulter counter method, and the difference between the volume average particle diameter of toner on the developing sleeve following making of many copies and that of the evaluated toner was used for judgment.

| Difference between the volume average particle diameter of toner on the developing sleeve following making of many copies and that of the evaluated toner (μm) | Selective developing evaluation standards |
|---|---|
| less than 1.00 | A |
| 1.00 or greater but less than 1.25 | B |
| 1.25 or greater but less than 1.50 | C |
| 1.50 or greater but less than 1.75 | D |
| 1.75 or greater | E |

Line Splattering (Degree of Line Images Being Smashed)

Line splattering evaluation was conducted as follows: First, an original image is created, which consists of patterns of 5 fine lines equal in line width and line spacing. The variations within the image are line spacing being 2.8 lines within 1 mm, 3.2 lines, 3.6, 4.0, 4.5, 5.0, 5.6, 6.3, 7.1, 8.0, 9.0, and 10.0 lines per mm. An original with these 12 types of patterns is copied under appropriate photocopying conditions, and the copied image was viewed under a magnifying glass to distinguish the number of fine lines (lines/mm) which can be discerned as being clearly separated from neighboring lines, which was used as the means for evaluation. Here, the greater the number of lines which are clearly separated from neighboring lines there are, i.e., the greater the value of lines per mm is, the better the state of line splattering is. The following shows the evaluation standards for line splattering.

| The number of fine lines (lines/mm) at the point that line splattering starts to occur | Line splattering evaluation standards |
|---|---|
| 8.0 | A |
| 7.1 | B |
| 6.3 | C |
| 5.6 | D |
| 5.0 | E |

Environmental Stability 20,000 copies were made under the following conditions: N/N environment (temperature 23.5° C., relative humidity 60% RH), H/H environment (temperature 30° C., relative humidity 80% RH), and N/L environment (temperature 23.5° C., relative humidity 5% RH); following which the image density of the copies made around 20,000 copies was used as the evaluation standard. The difference between the environment of these 3 exhibiting the highest density and that exhibiting the lowest density was used as the evaluation standard for environmental stability. The smaller difference in image density, the better the environmental stability was judged to be.

| Difference between the greatest image density vale and the lowest image density value | Environmental stability evaluation standards |
|---|---|
| less than 0.03 | A |
| 0.03 or greater but less than 0.05 | B |

-continued

| Difference between the greatest image density vale and the lowest image density value | Environmental stability evaluation standards |
|---|---|
| 0.05 or greater but less than 0.10 | C |
| 0.10 or greater but less than 0.13 | D |
| 0.13 or greater | E |

Fixing Properties

In order to evaluate fixing properties, the fixing unit for a CANON photocopier NP-9800 was reworked and an external testing fixing unit was created so as to allow for changing the process speed (fixing speed) and fixing roller temperature. Copies created with the CANON photocopier GP-55 of solid images and half-tone images were used in an unfixed state before passing through the fixing unit, in the test for fixing properties.

The solid images and half-tone images in an unfixed state were passed through the external testing fixing unit of which the fixing roller temperature was changed from 100° C. to 245° C. in increments of 5° C. The fixing properties of the fixed images having passed through the fixing unit were used for evaluation.

Evaluation of the fixing properties was conducted by rubbing the image with SIRUBON paper 10 times back and forth under approximately 100 g or pressure, and the drop in reflective density in % was used for evaluation of the image being rubbed off. The greater the drop in reflective density, the more toner is being rubbed off, meaning that the fixability of the toner is bad.

Solid images and half-tone images in an unfixed state were passed through the external testing fixing unit of which the temperature of the fixing roller was raised from 100° C. in increments of 5° C., and the temperature of the fixing roller at which the rate of drop in reflective density following rubbing of the fixed image became less than 10% was set as the fixing initiation temperature.

Regarding high-temperature offset, and evaluation of "good" was passed on samples where high-temperature offset did not occur up to temperatures of 240° C. of the fixing roller. The offset phenomena is a phenomena wherein part of the unfixed toner image, being in a soft and molten state because of the heat of the heating roller, is transferred to the surface of the fixing roller, thereby soiling it.

Regarding wrapping offset, any curling of the paper passing though the external fixing unit during testing of the fixing properties was judged to be bad, and those which exhibited no such curling to wrap onto the fixing roller were judged as being good.

Examples 2 to 10

Toners No. 2 to No. 10 were obtained in the same way as with Example 1, except that the binder resin and release agent were changed as shown in Table 3-1. The particle size after 20,000 was hardly any different than the initial value, with good image properties being obtained. The results of the testing are shown in Table 3-2.

In Examples 8 through 10, the following wax (b) was used as a release agent. Wax (b) was obtained from synthesized hydrocarbon wax by fractional crystallization by means of the Arge method. The DSC properties of the wax (b) were measured according to the following procedures.

Measurement of the DSC properties of the wax is conducted by measuring the heat exchange and behavior thereof, and according to measurement principles, it is necessary to conduct the measurement with a high-precision internal thermal input compensation type differential scanning calorimeter. The DSC-7 manufactured by PARKIN ELMER CO., LTD. may be used, for example.

The measurement method was conducted in accordance with ASTM D3418-82. The DSC curve used in the present invention is a DSC curve measured when the temperature is caused to rise once, wherein the previous hysteresis is taken, following which the temperature is lowered and raised in a range of 0 to 200° C. at a rate of 10° C./min. The definitions of the temperatures are as follows.

Endothermic peak of wax (positive direction is the endothermic direction)

Endothermic onset temperature of wax (OP): Within the temperature where the integrated value of the peak curve reaches maximum, a tangent line is drawn at the lowest temperature, and the intersection between this tangent line and the base line is this temperature.

Endothermic peak temperature of wax (PP): Peak-top temperature

Exothermic peak of wax (negative direction is the exothermic direction)

Temperature of exothermic peak of wax: Temperature of peak-top of maximum peak

Figure 2:
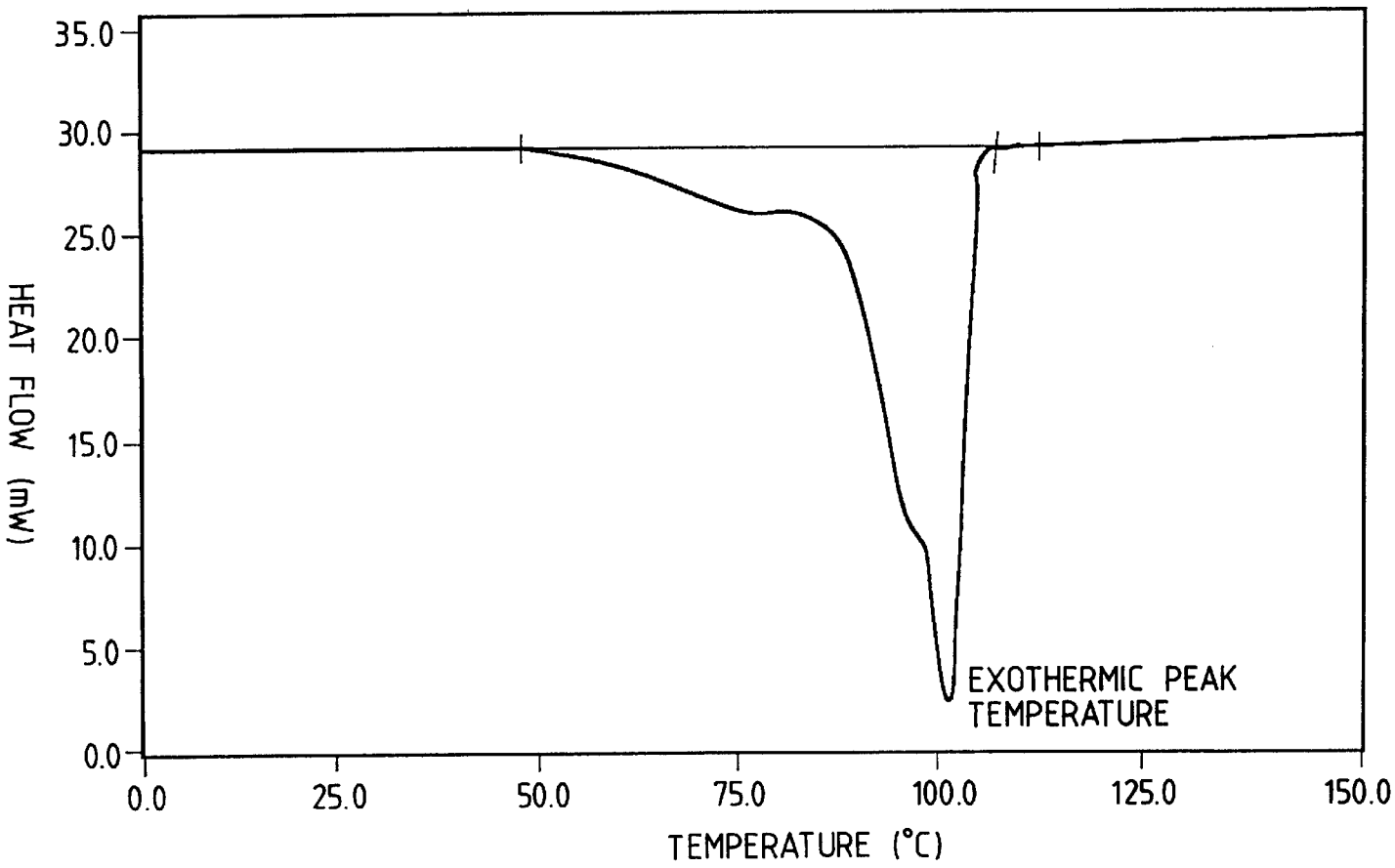
FIG. 2 shows a DSC curve for dropping temperature of the wax (b) used in the embodiment of the present invention.

DSC measurement of the wax (b) showed the onset temperature when the temperature was rising to be 67° C., the endothermic peak temperature when the temperature was rising to be 105° C., and the exothermic peak temperature when the temperature was falling to be 103° C. The DSC properties of wax (b) are shown in FIG. 1 and FIG. 2.

Comparative Examples 1 to 5

Comparative Examples 1 to 5 were obtained in the same way as with Example 1, except that changes were made to the binder resin as shown in Table. 3-1, and the thus prepared toner was evaluated in the same manner as with Example 1. The results thereof are shown in Table 3-2.

TABLE 3-1

| | | | Light scattering method measurement of preparation of the range of 2,000 to 100,000 in molecular weight prepared by preparative liquid chromatography of toner | | | Abundance ratio of the range of molecular weight of 2,000 to 100,000 of toner according to the GPC method (%) | Molecular weight of toner according to the GPC method | |
|---|---|---|---|---|---|---|---|---|
| | Resin | Release agent | Average molecular weight by weight (M) | Inertia radius (S) [Å] | Ratio (M/S) | | Mn | Mw |
| Example 1 | 1 | a | 840950 | 695 | 1210 | 84 | 8910 | 495000 |
| Example 2 | 2 | a | 416000 | 783 | 531 | 81 | 11700 | 186000 |

TABLE 3-1-continued

| | | | Light scattering method measurement of preparation of the range of 2,000 to 100,000 in molecular weight prepared by preparative liquid chromatography of toner | | | Abundance ratio of the range of molecular weight of | | |
|---|---|---|---|---|---|---|---|---|
| | Resin | Release agent | Average molecular weight by weight (M) | Inertia radius (S) [Å] | Ratio (M/S) | 2,000 to 100,000 of toner according to the GPC method (%) | Molecular weight of toner according to the GPC method Mn | Mw |
| Example 3 | 3 | a | 184240 | 425 | 434 | 77 | 8800 | 91500 |
| Example 4 | 5 | a | 1157000 | 3673 | 315 | 75 | 15700 | 841000 |
| Example 5 | 15 | a | 291000 | 1070 | 272 | 77 | 5950 | 269000 |
| Example 6 | 16 | a | 283000 | 1179 | 240 | 76 | 6350 | 271000 |
| Example 7 | 6 | a | 1214000 | 5518 | 220 | 71 | 17900 | 885000 |
| Example 8 | 2 | Wax b | 413000 | 778 | 531 | 81 | 11800 | 188000 |
| Example 9 | 15 | Wax b | 288900 | 1062 | 272 | 77 | 5940 | 268500 |
| Example 10 | 6 | Wax b | 1211000 | 5504 | 220 | 71 | 19700 | 886000 |
| Comparative Example 1 | 8 | a | 573600 | 3585 | 160 | 47 | 16800 | 848000 |
| Comparative Example 2 | 9 | a | 87120 | 545 | 160 | 93 | 5800 | 39700 |
| Comparative Example 3 | 17 | a | 271000 | 1935 | 140 | 78 | 6310 | 267000 |
| Comparative Example 4 | 7 | a | 53700 | 283 | 190 | 78 | 3150 | 47800 |
| Comparative Example 5 | 18 | a | 287000 | 2080 | 138 | 78 | 6200 | 271000 |

TABLE 3-2

| | Image properties | | | | | | Fixing properties | | | | | | |
|---|---|---|---|---|---|---|---|---|---|---|---|---|---|
| | | | | | | | Fixing speed: 100 mm/sec | | | Fixing speed: 500 mm/sec | | | |
| | Half-tone image quality | Maximum image density | Density gradation properties | Selective developing | Line splattering | Environmental stability | Temp. initiating fixing of solid black portion (° C.) | Temp. initiating fixing of half-tone portion (° C.) | High-temp. offset | Temp. initiating fixing of solid black portion (° C.) | Temp. initiating fixing of half-tone portion (° C.) | High-temp. offset | Wrapping offset |
| Example 1 | A | A | A | A | A | A | 125 | 125 | Good | 160 | 160 | Good | Good |
| Example 2 | A | A | A | A | A | A | 125 | 125 | Good | 160 | 160 | Good | Good |
| Example 3 | A | A | A | A | A | A | 130 | 130 | Good | 160 | 160 | Good | Good |
| Example 4 | A | A | A | B | A | B | 135 | 135 | Good | 170 | 170 | Good | Good |
| Example 5 | B | A | A | B | A | B | 140 | 140 | Good | 175 | 175 | Good | Good |
| Example 6 | B | A | A | B | A | B | 145 | 145 | Good | 175 | 175 | Good | Good |
| Example 7 | B | A | A | B | A | B | 150 | 150 | Good | 180 | 185 | Good | Good |
| Example 8 | A | A | A | A | A | A | 130 | 130 | Good | 165 | 165 | Good | Good |
| Example 9 | B | A | A | B | A | B | 145 | 145 | Good | 180 | 180 | Good | Good |
| Example 10 | B | A | A | B | A | B | 160 | 160 | Good | 185 | 185 | Good | Good |
| Comparative Example 1 | C | B | B | C | C | C | 170 | 170 | Good | 205 | 205 | Good | Good |
| Comparative Example 2 | C | B | B | C | C | C | 170 | 170 | Occurring at 195° C. | 205 | 205 | Occurring at 205° C. | Bad |
| Comparative Example 3 | C | C | C | C | C | C | 175 | 175 | Good | 205 | 205 | Good | Good |
| Comparative Example 4 | C | B | A | C | B | C | 165 | 165 | Good | 195 | 195 | Good | Good |
| Comparative Example 5 | C | C | C | C | C | C | 175 | 175 | Good | 205 | 205 | Good | Good |

What is claimed is:

1. A toner for developing an electrostatic image, comprising toner particles containing at least polyester resin as a binder resin and colorant, wherein (a) the polyester has no THF-insoluble component, (b) the number average molecular weight (mn) according to gel permeation chromatography (GPC method) of THF-soluble matter of said polyester resin is 1000 to 80,000, and (c) resin components in the range of 2,000 to 100,000 according to molecular distribution measurement by the Gel Permeation Chromatography (GPC method) of THF-soluble matter of the polyester resin are 50% to 90% based on the THF-soluble matter of the polyester resin; and the resin components of a range of 2,000 to 100,000 in molecular weight exhibit an M/S ratio of 420 to 2,000, the M and S being a weight average molecular weight (M) measured by means of light scattering method and an inertia radius (S) measured by means of light scattering method, respectively.

2. The toner according to claim 1, wherein said binder resin is a polyester resin, and the weight average molecular weight (Mw) according to GPC method of the THF-soluble matter of said polyester resin is 5,000 to 10,000,000.

3. The toner according to claim 2, wherein the acid value of said polyester resin is 2 to 70.

4. The toner according to claim 3, wherein the OH value of said polyester resin is 50 or less.

5. The toner according to claim 2, wherein the glass transition temperature of said polyester resin is 45 to 80° C.

6. The toner according to claim 5, wherein the glass transition temperature of said polyester resin is 50 to 70° C.

7. The toner according to claim 2, wherein said polyester resin is generated by means of preparing linear polyester of low molecular weight and linear polyester of high molecular weight separately in advance, and adding polyhydric alcohol or polycarboxylic acid having 3 or more hydroxyl or carboxyl groups when blending the polyester molecule obtained thus, thereby conducting condensation polymerization.

8. The toner according to claim 1, wherein the number average molecular weight (Mn) according to GPC method of said polyester resin is 1,500 to 50,000, and the weight average molecular weight (Mw) according to GPC method is 10,000 to 5,000,000.

9. The toner according to claim 1, wherein said toner particles contain an aliphatic hydrocarbon wax wherein a DSC curve measured by means of a differential scanning calorimeter exhibits the following properties regarding the endothermic peak during rising of temperature and the exothermic peak during dropping of temperature, such that the endothermic onset is within the range of 50 to 110° C., having at least one endothermic peak within the range of 70 to 130° C., and the maximum exothermic peak for dropping temperature exists within a range of ±9° C. of the aforementioned endothermic peak.

10. The toner according to claim 1, wherein said toner particles contain an aliphatic alcohol wax represented by the following Expression (1), $$CH_3(CH_2)_XCH_2OH \quad (1)$$

wherein X represents an average value, and is an integer in the range of 20 to 250.

11. The toner according to claim 1, wherein said toner particles contain an alkyl monocarboxylic acid wax represented by the following Expression (2), $$CH_3(CH_2)_YCH_2COOH \quad (2)$$

wherein Y represents an average value, and is an integer in the range of 20 to 250.

* * * * *

UNITED STATES PATENT AND TRADEMARK OFFICE

CERTIFICATE OF CORRECTION

PATENT NO. : 6,017,669

DATED : January 25, 2000

INVENTOR(S) : MAKOTO UNNO ET AL.

It is certified that error appears in the above-identified patent and that said Letters Patent is hereby corrected as shown below:

ON THE TITLE PAGE

[57] Abstract:

Line 4, "chromatograph" should read --chromatography--.

COLUMN 1:

Line 21, "may" should read --many--.

COLUMN 6:

Line 20, "a" should read --one--.

COLUMN 9:

Line 26, "groups" should read --group--.

COLUMN 12:

Line 24, "residue" should read --residues--.

COLUMN 14:

Line 63, "silylmelcaptan" (both occurrences) should read --silylmercaptan--.

UNITED STATES PATENT AND TRADEMARK OFFICE

CERTIFICATE OF CORRECTION

PATENT NO. : 6,017,669

DATED : January 25, 2000

INVENTOR(S) : MAKOTO UNNO ET AL.

It is certified that error appears in the above-identified patent and that said Letters Patent is hereby corrected as shown below:

COLUMN 16:

Line 3, "for used" should read--is suitable for use--.

COLUMN 19:

Line 61, "to" should read --into--.

COLUMN 20:

Line 1, "is" should read --it is--;
Line 4, "$10_7$" should read --$10^7$--;
Line 12, "G200OH($H_{XL}$)" should read--G2000H($H_{XL}$)--;
Line 18, "upto" should read --up to--;
Line 33, "PARKIN ELMER CO., LTD." should read --Perkin-Elmer Co., Ltd.)--; and
Line 48, "mising" should read --mixing--.

COLUMN 21:

Line 14, "a" should read --$\alpha$--.

COLUMN 26:

Line 41, "83parts" should read --83 parts--; and
Line 59, "benzoil" should read --benzoyl--.

UNITED STATES PATENT AND TRADEMARK OFFICE

CERTIFICATE OF CORRECTION

PATENT NO. : 6,017,669

DATED : January 25, 2000

INVENTOR(S) : MAKOTO UNNO ET AL.

It is certified that error appears in the above-identified patent and that said Letters Patent is hereby corrected as shown below:

COLUMN 27:

Line 64, "Hell5 oersted, δ80 emy/g, arllemu/g), should read --He=115 oersted, δ=80 emu/g, 6rsllemu/g),--.

COLUMN 31:

Line 29, "or" should read --of--; and
Line 41, "and" should read--an--.

COLUMN 32:

Line 18, "PARKIN" should read--Perkin---.

Signed and Sealed this

Tenth Day of April, 2001

*Attest:*

Nicholas P. Godici

NICHOLAS P. GODICI

*Attesting Officer*

*Acting Director of the United States Patent and Trademark Office*